US007383888B2

(12) United States Patent
Sivley, IV

(10) Patent No.: US 7,383,888 B2
(45) Date of Patent: Jun. 10, 2008

(54) EXPANSION PIG

(75) Inventor: Robert S. Sivley, IV, Kingwood, TX (US)

(73) Assignee: Hydril Company, Houston, TX (US)

( * ) Notice: Subject to any disclaimer, the term of this patent is extended or adjusted under 35 U.S.C. 154(b) by 0 days.

(21) Appl. No.: 11/688,096

(22) Filed: Mar. 19, 2007

(65) Prior Publication Data

US 2007/0163786 A1 Jul. 19, 2007

Related U.S. Application Data

(63) Continuation of application No. 10/958,979, filed on Oct. 5, 2004, now Pat. No. 7,191,841.

(51) Int. Cl.
*E21B 43/10* (2006.01)
*E21B 23/04* (2006.01)

(52) U.S. Cl. ..... 166/380; 166/382; 166/212; 166/207

(58) Field of Classification Search ..... 166/380, 166/383, 384, 207, 210, 217, 206, 382, 212; 73/370.06; 72/370.06
See application file for complete search history.

(56) References Cited

U.S. PATENT DOCUMENTS

| | | | | |
|---|---|---|---|---|
| 6,568,472 | B1 * | 5/2003 | Gano et al. | 166/207 |
| 7,036,582 | B2 * | 5/2006 | Cook et al. | 166/207 |
| 2004/0094312 | A1 * | 5/2004 | Lohbeck et al. | 166/384 |
| 2006/0102360 | A1 * | 5/2006 | Brisco et al. | 166/380 |

* cited by examiner

*Primary Examiner*—Kenneth Thompson
(74) *Attorney, Agent, or Firm*—Osha Liang, LLP

(57) ABSTRACT

A tool for radially expanding casing having a tool body that includes a proximal end, a distal end, and an outer surface. The tool includes at least one hydraulic channel disposed axially. The at least one hydraulic channel transmits hydraulic pressure from behind the expansion tool forward in the direction of travel of the expansion tool.

12 Claims, 10 Drawing Sheets

EXPANSION PIG

CROSS-REFERENCE TO RELATED APPLICATIONS

This application is a continuation of U.S. patent application Ser. No. 10/958,979, filed Oct. 5, 2004 now U.S. Pat. No. 7,191,841.

BACKGROUND OF INVENTION

1. Field of the Invention

The invention relates generally to an expansion tool and method adapted for use with oilfield pipes ("tubulars"). More specifically, the invention relates to an expansion tool used to plastically radially expand downhole tubular members in a wellbore.

2. Background Art

Casing joints, liners, and other oilfield tubulars are often used in drilling, completing, and producing a well. Casing joints, for example, may be placed in a wellbore to stabilize a formation and protect a formation against high wellbore pressures (e.g., wellbore pressures that exceed a formation pressure) that could damage the formation. Casing joints are sections of steel pipe, which may be coupled in an end-to-end manner by threaded connections, welded connections, and other connections known in the art. The connections are usually designed so that a seal is formed between an interior of the coupled casing joints and an annular space formed between exterior walls of the casing joints and walls of the wellbore. The seal may be, for example, an elastomer seal (e.g., an o-ring seal), a metal-to-metal seal formed proximate the connection, or similar seals known in the art.

In some well construction operations, it is advantageous to radially plastically expand threaded pipe or casing joints in a drilled ("open") hole or inside a cased wellbore. Radially plastically expanding a pipe, as used in this application, describes a permanent expansion, or increase, of the inside diameter of a pipe or casing. The casing might experience some elastic recovery, where the diameter decreases slightly from the largest expanded diameter, but the final diameter will be permanently larger than the initial diameter. In a cased wellbore, radially expandable casing can be used to reinforce worn or damaged casing so as to, for example, increase a burst rating of the old casing, thereby preventing premature abandonment of the hole.

In conventional oilfield drilling, casing strings are installed at regular intervals throughout the drilling process. The casing for one interval is installed by lowering it through the casing for a previous interval. This means that the outer diameter of a casing string is limited by the inner diameter of previously installed casing strings. Thus, the casing strings in a conventional wellbore are nested relative to each other, with casing diameters decreasing in a downward direction with each interval.

An annular space is provided between each string of casing and the wellbore so that cement may be pumped into the annular space or annulus to seal between the casing and the wellbore. Because of the nested arrangement of the casing strings in a conventional wellbore and the annular space required around the casing strings for cement, the hole diameter required at the top of the wellbore may be relatively large. This large initial wellbore diameter leads to an increased expense of drilling large diameter holes and the added expense of cementing a large casing string. In addition, the nested arrangement of the casing strings in a conventional wellbore can severely limit the inner diameter of the final casing string at the bottom of the wellbore, which restricts the potential production rate of the well.

It is desirable that a casing string can be plastically radially expanded in situ (i.e., in place in the well) after it has been run into the wellbore through the previous casing string. This minimizes the reduction of the inner diameter of the final casing string at the bottom of the wellbore. Plastically radially expanding a casing string in the wellbore has the added benefit of reducing the annular space between the drilled wellbore and the casing string, which reduces the amount of cement required to effect a seal between the casing and the wellbore.

Various techniques to expand casing have already been developed. One technique uses an expansion tool, called a "pig," which has a diameter that is larger than the inside diameter of the casing string. The tool is typically moved through a string of casing or tubing to plastically radially expand the string from an initial condition (e.g., from an initial diameter) to an expanded condition (e.g., to a final diameter). One common prior-art expansion process uses a conically tapered, cold-forming expansion tool to expand casing in a wellbore. The expansion tool is generally symmetric about its longitudinal axis. The expansion tool also includes a cylindrical section having a diameter typically corresponding to a desired expanded inside diameter of a casing string. The cylindrical section is followed by a tapered section.

The expansion tool is placed into a launcher at the bottom of the expandable casing string. The launcher is a belled section, threaded at one end and sealed off on the distal end with a cementing port in the bottom. The expansion tool is sealed inside the launcher and the launcher is made-up on the end of the expandable casing string. The casing string is set in place in the hole, usually by hanging-off the casing string from a casing hanger. Then, a working string of drillpipe or tubing is run into the wellbore and attached to the expansion tool (e.g., the working string is generally attached to the leading mandrel). The expansion tool may also comprise an axial bore therethrough so that pressurized fluid (e.g., drilling fluid) may be pumped through the working string, through the expansion tool, and into the wellbore so as to hydraulically pressurize the wellbore. Hydraulic pressure acts on a piston surface defined by a lower end of the expansion tool, and the hydraulic pressure is combined with an axial upward lifting force on the working string to force the expansion tool upward through the casing string so as to outwardly radially displace the casing string to a desired expanded diameter.

In a variation of this method, as the launcher just clears the casing shoe of the parent casing, the casing is expanded while the expansion tool is held still in space. The casing is simultaneously expanded and driven into the hole.

Alternatively, an expansion tool is mounted on the end of a long hydraulic cylinder. The cylinder and tool are run into the hole with the expandable casing suspended below on a hanger. The cylinder pushes the expansion tool into the casing string, making the liner hanger. The hydraulic cylinder and internal slip are retracted, the slips are reset in a new position, and the hydraulic cylinder is extended again. The process is repeated until the entire string is expanded.

In another method known in the art, the expansion tool has three retractable, angled rollers arrayed around the outside of the tool. The expandable casing is lowered into the hole on a set of clips carried above the expansion tool. At depth, the tool is rotated and pressure is slowly applied to the tool, causing the rollers to move radially outwards. The tool is then pushed or pulled through the casing while rotating.

Radial expansion may be performed at rates of, for example, 25 to 60 feet per minute. Other expansion processes, such as expansion under localized hydrostatic pressure, or "hydroforming," are known in the art, but are generally not used as much as the cold-forming expansion process.

FIG. 1 shows a sectional drawing of a typical prior art conical expansion tool 100 (or "expansion pig") beginning to deform casing pipe 117. The end 112 of the casing string 117 contacts the expansion tool 100 on a frustoconical expansion surface 105 of the tool 100. As the expansion tool 100 moves in the direction of travel 104, it will pass through the casing string 117, plastically radially expanding the casing string 117 as it moves.

The expansion tool 100, symmetric about centerline 103, has a cylindrical section 110, the diameter of which is about the same as the desired expanded diameter for the casing string 117. Typically, the expanded casing will recoil slightly from the diameter of the cylindrical section 110, and thus, the final expanded diameter of the casing 117 will be slightly less than the outer diameter of the cylindrical section 110. At the back end, the expansion tool 100 has a tapered section 111 that falls away from the cylindrical section 110.

SUMMARY OF INVENTION

In one aspect, the invention comprises a tool having a tool body that includes a proximal end, a distal end, and an outer surface. The tool body also includes at least one hydraulic channel and a vent channel. The hydraulic channel is bored through the tool and disposed axially extending from the distal end of the tool body to a point behind a forward contact ring, along a direction of travel. The vent channel connects the axial channel to the surface of the tool. The expansion tool is adapted to control fluid flow from behind the distal end of the tool to a location in front of the proximal end.

In another aspect, the invention comprises a tool having a tool body that includes a proximal end, a distal end, and an outer surface. The tool body also includes at least one hydraulic channel and at least one circumferential channel. The hydraulic channel bored through the tool and disposed axially extending from the distal end of the tool body to a point behind a forward contact ring, along a direction of travel. A vent channel connects the axial channel and the circumferential channel disposed on the surface of the tool behind the forward contact surface. The expansion tool is adapted to control fluid flow from behind the distal end of the tool to a location in front of the proximal end.

In another aspect, the invention comprises a tool having a tool body that includes a proximal end, a distal end, and an outer surface. The tool body also includes at least one hydraulic channel disposed on the surface of the tool. The hydraulic channel is disposed axially extending from the distal end of the tool body to a point behind a forward contact ring, along a direction of travel. The expansion tool is adapted to control fluid flow from behind the distal end of the tool to a location in front of the proximal end.

In another aspect, the invention comprises a tool having a tool body that includes a proximal end, a distal end, and an outer surface. The tool body also includes at least one hydraulic channel. A sealing body is disposed axially in front of the tool body, along the direction of travel. The hydraulic channel is bored through the tool and disposed axially extending from the distal end to the proximal end of the tool body. The expansion tool is adapted to control fluid flow from behind the distal end of the tool to a location in front of the proximal end.

In another aspect, the invention comprises a tool having a tool body that includes a proximal end, a distal end, and an outer surface. The tool body also includes at least one hydraulic channel. A sealing body is disposed axially in front of the tool body, along the direction of travel. The hydraulic channel is bored through the tool and disposed axially extending from the distal end to the proximal end of the tool body. A vent channel connects the axial hydraulic channel to a circumferential channel disposed on the surface of the tool behind a forward contact ring. The expansion tool is adapted to control fluid flow from behind the distal end of the tool to a location in front of the proximal end.

In another aspect, the invention comprises a tool having a tool body that includes a proximal end, a distal end, and an outer surface. The tool body also includes at least one hydraulic channel. A sealing body is disposed axially in front of the tool body, along the direction of travel. The hydraulic channel is disposed on the surface of the tool, axially extending from the distal end to the proximal end of the tool body. The expansion tool is adapted to control fluid flow from behind the distal end of the tool to a location in front of the proximal end.

In another aspect, the invention comprises a tool having a tool body that includes a first section, a second section, a proximal end, a distal end, and an outer surface. The diameter of the first section increases at a rate that increases toward the distal end of the tool, and the diameter of the second section increases at a rate that decreases toward the distal end of the tool. A sealing body is disposed axially in front of the tool body, along the direction of travel. The tool body also includes at least one hydraulic channel. The hydraulic channel is bored through the tool and disposed axially extending from the distal end to the proximal end of the tool body. The expansion tool is adapted to control fluid flow from behind the distal end of the tool to a location in front of the proximal end.

In another aspect, the invention comprises a tool having a tool body that includes a first section, a second section, a proximal end, a distal end, and an outer surface. The diameter of the first section increases at a rate that increases toward the distal end of the tool, and the diameter of the second section increases at a rate that decreases toward the distal end of the tool. A sealing body is disposed axially in front of the tool body, along the direction of travel. The tool body also includes at least one hydraulic channel. The hydraulic channel is bored through the tool and disposed axially extending from the distal end to the proximal end of the tool body. A vent channel connects the axial hydraulic channel to a circumferential channel disposed on the surface of the tool. The expansion tool is adapted to control fluid flow from behind the distal end of the tool to a location in front of the proximal end.

In another aspect, the invention comprises a method of forcing an expansion tool through a casing segment. The hydraulic pressure behind the expansion tool is transmitted through at least one channel to a point behind a forward contact surface, in a direction of travel. At least one pressure regulation valve regulates the pressure at the point behind the forward contact surface.

In another aspect, the invention comprises a method of forcing an expansion tool through a casing segment. The hydraulic pressure behind the expansion tool is transmitted through at least one channel to a point ahead of a proximal end. The expansion tool is adapted to control the fluid flow from behind the distal end to a point in front of the proximal end. At least one pressure regulation valve regulates the pressure in the area between the proximal end of the tool body and the sealing body.

Other aspects and advantages of the invention will be apparent from the following description and the appended claims.

DETAILED DESCRIPTION

Embodiments of the invention relate to expansion tools used to radially plastically expand threaded pipe or casing joints. In accordance with embodiments of the invention, the hydraulic pressure used to move the expansion tool through the casing is transmitted forward to pre-stress the casing and attenuate the wave-like response of the casing.

Figure 1:
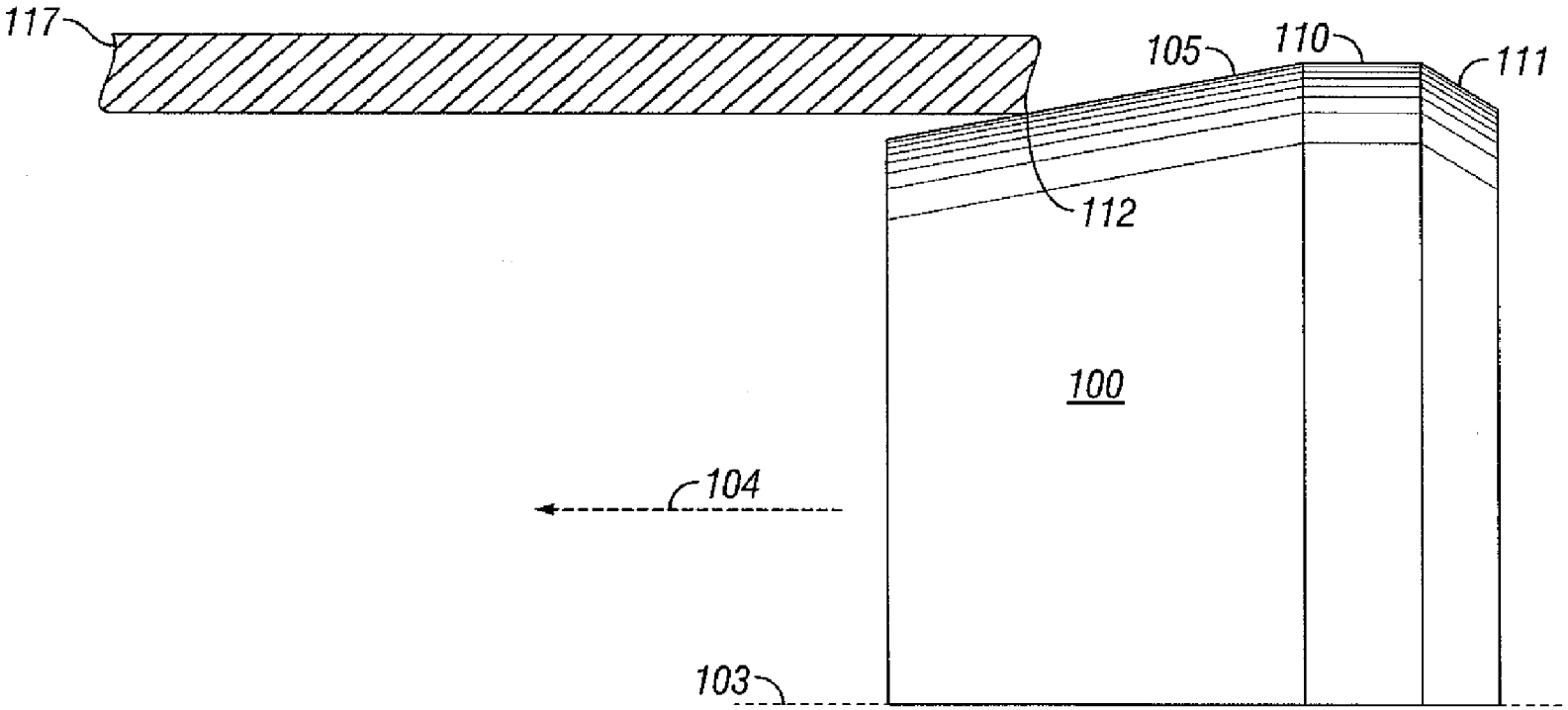
FIG. 1 (Prior Art)
FIG. 1 shows a sectional view of a typical prior art conical expansion tool, beginning to deform casing pipe.
Figure 2:
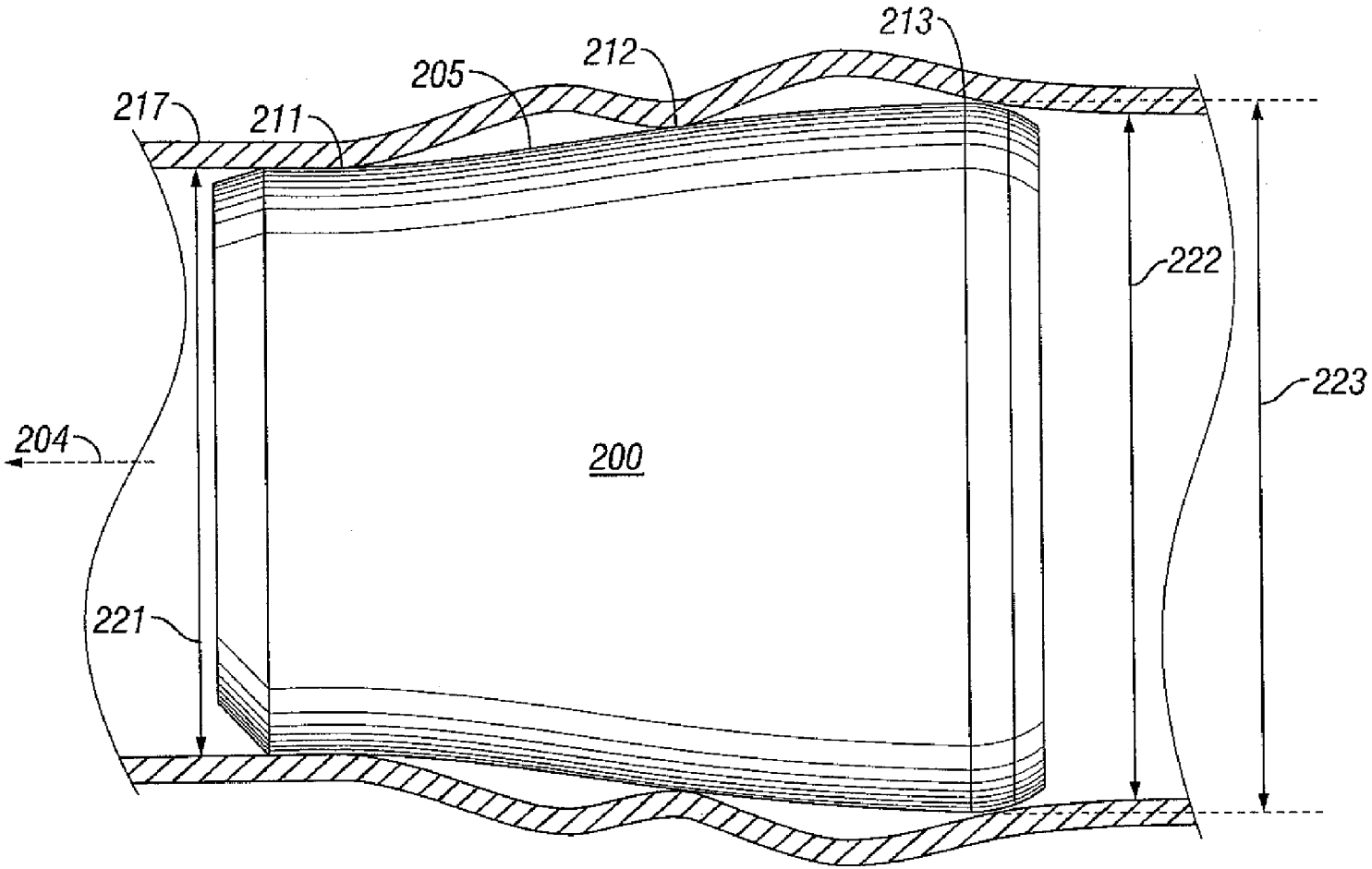
FIG. 2 shows a cross-sectional view of an expansion tool moving through a casing.

FIG. 2 shows a cross-section of an expansion tool 200 expanding a section of a casing string 217. The tool 200 is moving in a direction of travel 204. As the tool 200 moves, it expands the casing string 217 from an initial diameter 221 to an expanded diameter 222. The expanded diameter 222 is slightly less than the largest diameter 223 of the expansion tool due to the elastic recovery of the casing 217. In some embodiments, the expansion tool 200 is moved through the casing 217 aided by hydraulic pressure behind the expansion tool 200 in the direction of travel 204. The hydraulic pressure results from fluid pumped into the wellbore through the drill pipe (not shown) to the area behind the expansion tool.

As the expansion tool 200 moves through the casing 217, it radially plastically expands the casing 217. The casing 217 has a visco-elastic, or wave-like, response to the expansion process. The inside of the casing string 217 first contacts the tool 200 on the expansion surface 205 at point 211. When the casing 217 deforms outwardly, it essentially "bounces" off of the expansion surface 205. Following the "bounce," the casing relaxes and again contacts the expansion tool 200 at a second contact point 212.

The wavelike behavior of the casing is because steel, in its plastic state, responds visco-elastically to expansion. Thus, the expansion is shear-rate sensitive. The exact number and position of the contact rings (e.g., 211, 212, 213) on the expansion tool 200, as well as the amplitude of the wave, depend on the design of the expansion tool 200, the coefficient of friction between the tool 200 and the casing 217, the casing material, diameter and thickness of the casing 217, and the speed of travel of the expansion tool 200. The amplitude of the casing wave is also dependent on the expansion ratio, inherent in the expansion tool 200 design. The expansion ratio, conventionally, is the ratio of the expanded inside diameter 222 of the casing 217 to the initial inside diameter 221 of the casing 217.

In embodiments of the invention described herein, a channel disposed on the surface of the expansion tool or bored through the expansion tool will transmit the hydraulic pressure from behind the expansion tool to a point ahead of the distal end of the tool. Pressure regulation valves may be used to set the hydraulic pressures at various points along and ahead of the expansion tool. The expansion tool is adapted to control fluid flow from behind the distal end to in front of the proximal end of the expansion tool.

Figure 3A:
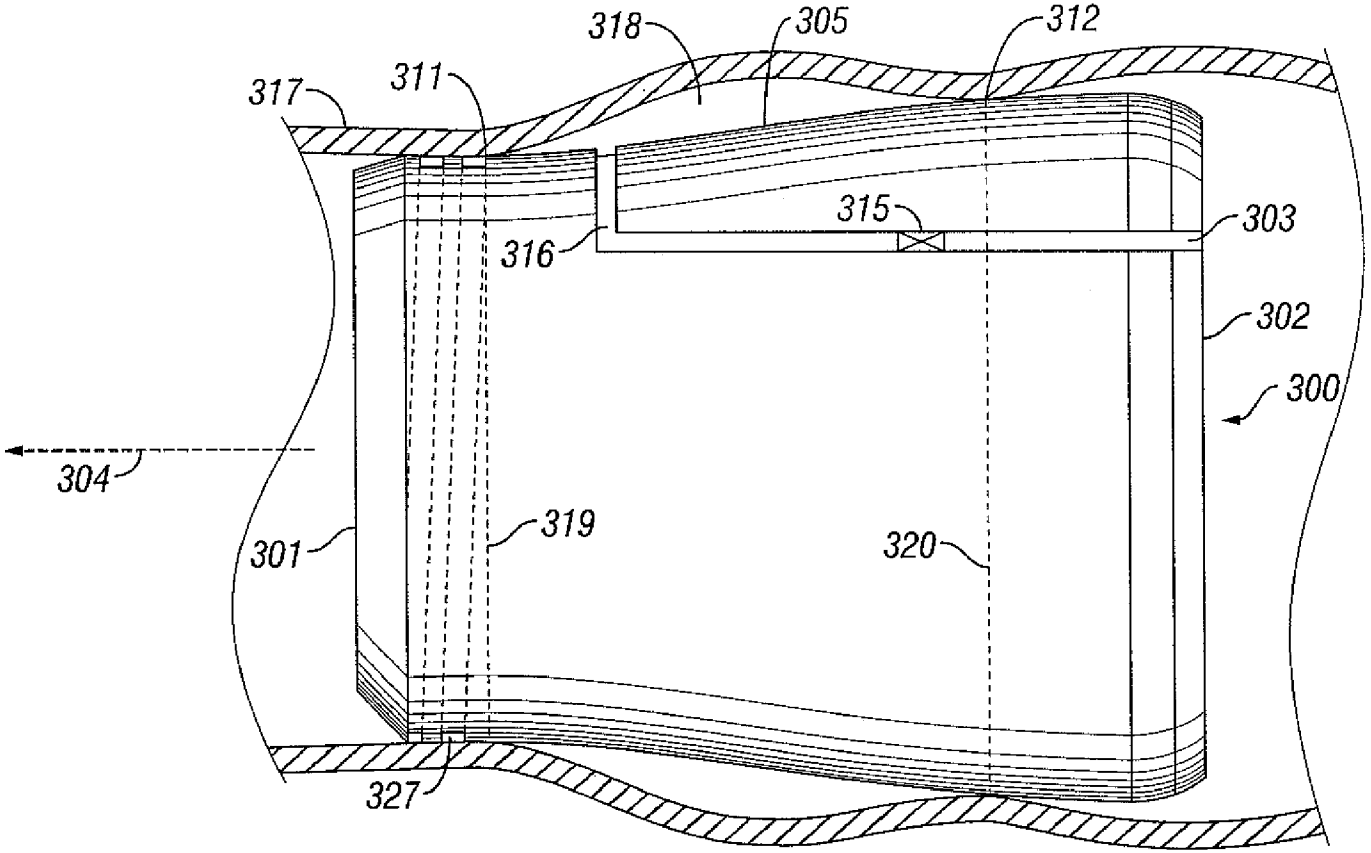
FIG. 3A shows a cross-sectional view of an embodiment of the expansion tool of the current invention.

FIG. 3A shows a cross-section of an embodiment of the expansion tool 300 of the current invention entering a casing or pipe 317 to be expanded. Expansion tool 300 has a proximal end 301, a distal end 302, and an outer surface 305. The proximal end is the forward end of the expansion tool, and the distal end is the back end of the expansion tool. One skilled in the art will appreciate, however, that an expansion tool in accordance with the invention may have a pear shape or cone shape, where the proximal end or distal end may not have a distinct forward or back end surface. A contact ring 319 forms at the position of a first contact point 311 on the expansion surface 305 of the tool 300. The expansion tool 300 is forced through the casing 317 in a direction of travel 304. In this embodiment, at least one hydraulic channel 303, bored through the expansion tool 300, extends axially from the distal end 302 to a point behind the forward contact ring 319. A vent channel 316 connected to the axial channel 303 transmits the hydraulic pressure from the distal end 302 of the expansion tool 300 through the axial channel 303 to enter a volume 318 located between the two contact rings (e.g. 319, 320). At least one pressure regulation valve 315 disposed in the channel 303 or 316 can be used to regulate the pressure in the hydraulic channels 303, 316. One skilled in the art will appreciate that different pressures in volume 318 may be used, depending on the design of the expansion tool, coefficient of friction, the casing material properties and dimensions, and the speed of travel of the expansion tool 300.

The hydraulic pressure contained in volume 318 attenuates the wave-like behavior of the casing 317 by dampening the rebound of the steel, thus moving the subsequent contact ring 320 to a location axially behind the location of a subsequent contact ring (e.g., 220 in FIG. 2) created by a conventional expansion tool. Hydraulic horsepower transmitted to the space between the casing 317 and the expansion tool 300 created by the wave-like movement of the casing 317, reduces the axial force required to expand the casing 317. The hydraulic pressure also provides lubrication between the expansion tool and the inside surface of the casing. For added lubrication, fluids can also be pumped downhole in a slug, or pill, through the drillpipe and out the channels 303, 316, 308 in the expansion tool. A slug, or a pill, is a small volume of a special blend of drilling fluids that is sent down through the drillpipe. The expansion tool 300 is adapted to control the fluid flow from behind the distal end 302 to a location in front of the proximal end 301. A small helical groove 325 disposed circumferentially around the proximal end 301 of the expansion tool 300 controls the fluid flow, or transmits the fluid, from the volume 318 to in front of the proximal end 301 of the expansion tool 300. (Note, the helical groove 327 is shown in FIG. 3A with a dash-dot line as it would be seen from a side view of the expansion tool.) One with ordinary skill in the art will appreciate that the size and number of turns of the helical groove may vary depending on the desired rate of fluid flow to a location in front of the expansion tool 300. This allows slugs or hydraulic fluid to be transmitted to a location in front of the proximal end 301 of the tool 300 to increase lubricity. Those of ordinary skill in the art will appreciate that other methods may be used to control the rate of fluid flow. For example, pressure regulation valves or small axial grooves in the expansion tool 300 may be used to transmit the slugs to a location in front of the proximal end 301.

Figure 3B:
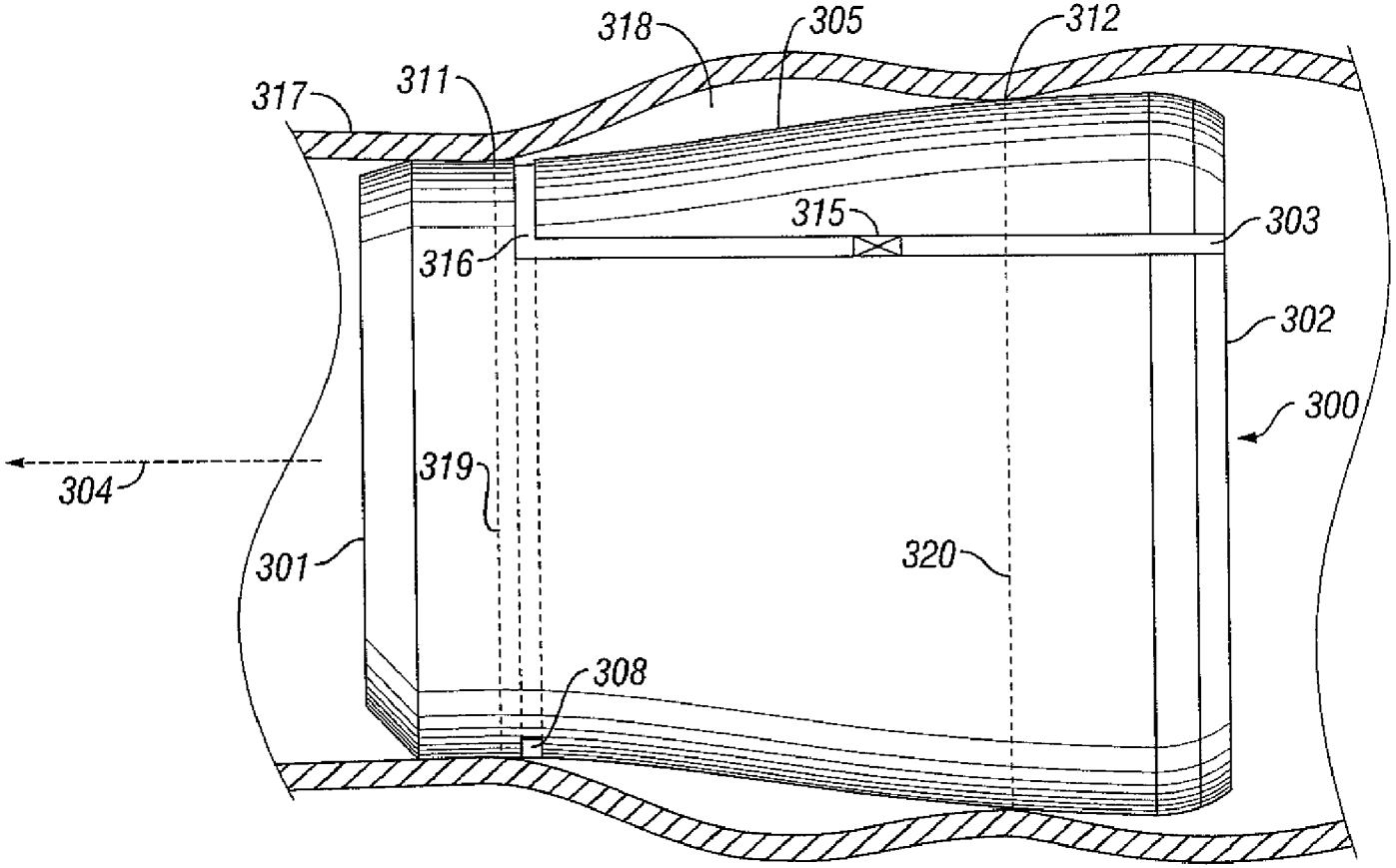
FIG. 3B shows a cross-sectional view of another embodiment of the expansion tool of the current invention.

FIG. 3B shows a cross-section of an embodiment of the expansion tool 300 of the current invention entering a casing or pipe 317 to be expanded. Expansion tool 300 has a proximal end 301, a distal end 302, and an outer surface 305. A contact ring 319 forms at the position of a first contact point 311 on the expansion surface 305 of the tool 300. The expansion tool 300 is forced through the casing 317 in a direction of travel 304. The hydraulic channel 303, bored through the expansion tool 300, transmits the hydraulic pressure behind the distal end 302 of the expansion tool 300 forward, in the direction of travel 304, to a vent channel 316 that opens up to a circumferential hydraulic channel 308 located on the outer surface 305 of the expansion tool 300 behind the forward contact ring 319. Note the dashed lines show the circumferential channel 308, as it would appear in a side view of the tool, encircling the perimeter of the expansion tool 300. The expansion tool 300 may comprise a plurality of circumferential channels 308, each disposed behind a contact ring (e.g. 319 or 320).

At least one pressure regulating valve 315 disposed in the channel can be used to regulate the pressure in the hydraulic channels. One skilled in the art will appreciate that different pressures may be used, depending on the design of the expansion tool, coefficient of friction, the casing material properties and dimensions, and the speed of travel of the expansion tool 300. The hydraulic pressure contained in the circumferential channel 308 attenuates the wave-like behavior of the casing 317 by dampening the rebound of the steel, thus moving subsequent contact ring 320 to a location axially behind the location of a subsequent contact ring (e.g., 220 in FIG. 2) created by a conventional expansion tool. That is, the distance between consecutive contact rings 319, 320 is lengthened. Hydraulic horsepower transmitted to the space between the casing 317 and the expansion tool 300 created by the wave-like movement of the casing 317, reduces the axial force required to expand the casing 317. The hydraulic pressure also provides lubrication between the expansion tool and the inside surface of the casing. For added lubrication, fluids can also be pumped downhole in a slug, or pill, through the drillpipe and out the channels 303, 316, 308 in the expansion tool. The expansion tool 300 is adapted to control the fluid flow from behind the distal end 302 to a location in front of the proximal end 301. A small helical groove may be disposed circumferentially around the proximal end 301 of the expansion tool 300 to control the fluid flow, or transmit the fluid, from the volume 318 to in front of the proximal end 301 of the expansion tool 300. This allows slugs or hydraulic fluid to be transmitted to a location in front of the proximal end 301 of the tool 300 to increase lubricity. Those of ordinary skill in the art will appreciate that other methods may be used to control the rate of fluid flow. For example, pressure regulation valves or small axial grooves in the expansion tool 300 may be used to transmit the slugs to a location in front of the proximal end 301.

Figure 3C:
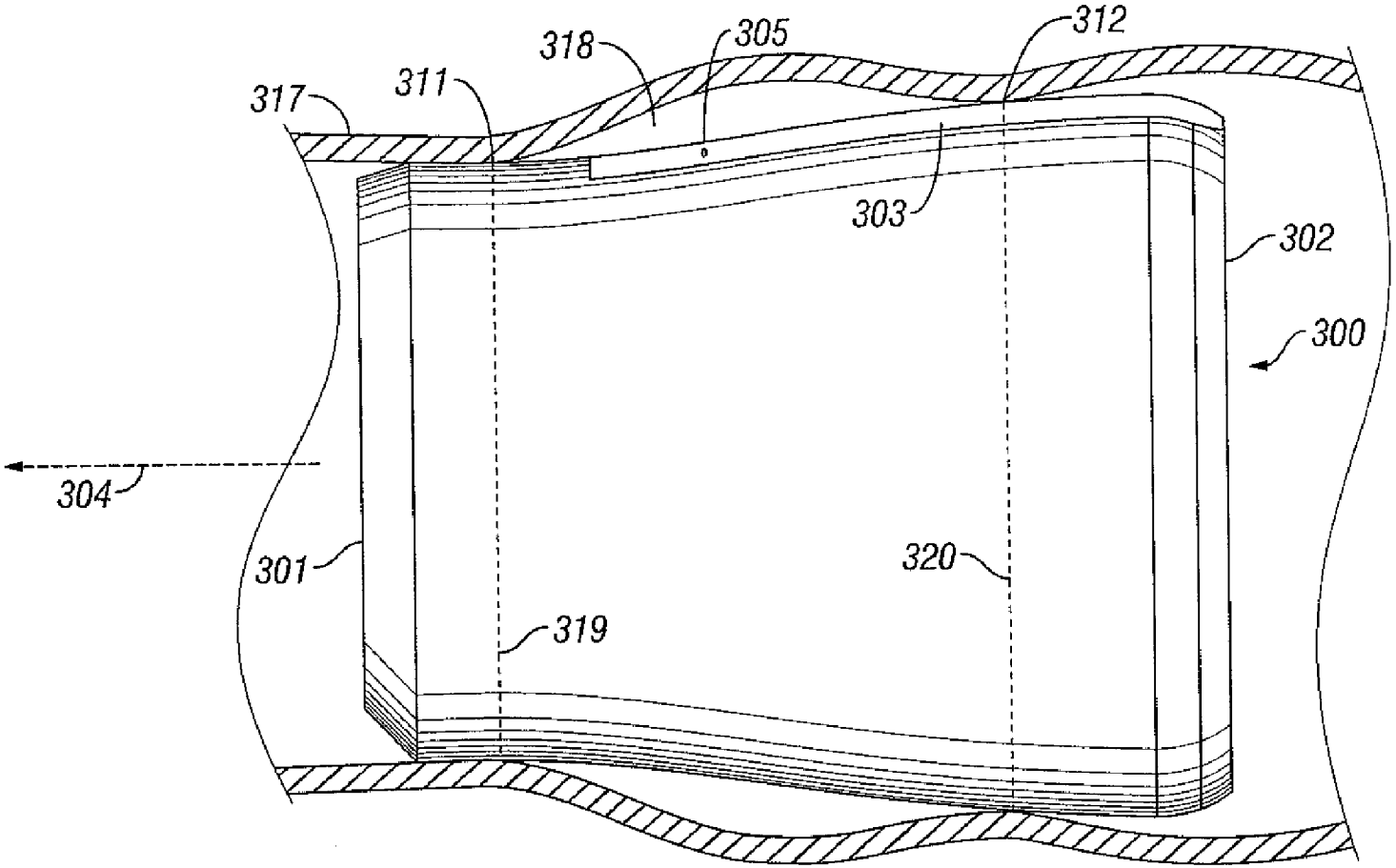
FIG. 3C shows a cross-sectional view of another embodiment of the expansion tool of the current invention.

FIG. 3C shows a cross section of an embodiment of the expansion tool 300 of the current invention entering a casing or pipe 317 to be expanded. The expansion tool 300 is similar to that presented in FIG. 3A; however, at least one hydraulic channel 303 is disposed on the surface 305 of the expansion tool 300. One skilled in the art will appreciate that different axial lengths and the circumferential widths of the channel may be used, depending on the design of the expansion tool, coefficient of friction, the casing material properties and dimensions, and the speed of travel of the expansion tool 300. The at least one hydraulic channel 303 allows the hydraulic pressure from behind the expansion tool 300 to be transmitted along the outside diameter of the tool to a point forward from the distal end 302 of the tool 300. The expansion tool 300 may also comprise a circumferential channel (e.g., 308 in FIG. 3B), disposed on the outer surface 305 of the expansion tool 300 behind the forward contact ring 319. The expansion tool 300 may comprise a plurality of circumferential channels 308, each disposed behind a contact ring (e.g. 319 or 320). The hydraulic channel 303 transmits the hydraulic pressure from behind the tool 300 to the volume 318. Hydraulic horsepower transmitted to the space between the casing 317 and the expansion tool 300 created by the wave-like movement of the casing 317, reduces the axial force required to expand the casing 317. The hydraulic pressure lubricates the area between the inside surface of the casing 317 and the tool 300 inside the casing, making it easier to move the expansion tool 300 through the casing 317.

The expansion tool 300 is also adapted to control the fluid flow from behind the distal end 302 to a location in front of the proximal end 301. A small helical groove may be disposed circumferentially around the proximal end 301 of the expansion tool 300 to control the fluid flow, or transmit the fluid, from the volume 318 to in front of the proximal end 301 of the expansion tool 300. This allows slugs or hydraulic fluid to be transmitted to a location in front of the proximal end 301 of the tool 300 to increase lubricity. Those of ordinary skill in the art will appreciate that other methods may be used to control the rate of fluid flow. For example, pressure regulation valves or small axial grooves in the expansion tool 300 may be used to transmit the slugs to a location in front of the proximal end 301.

Figure 4A:
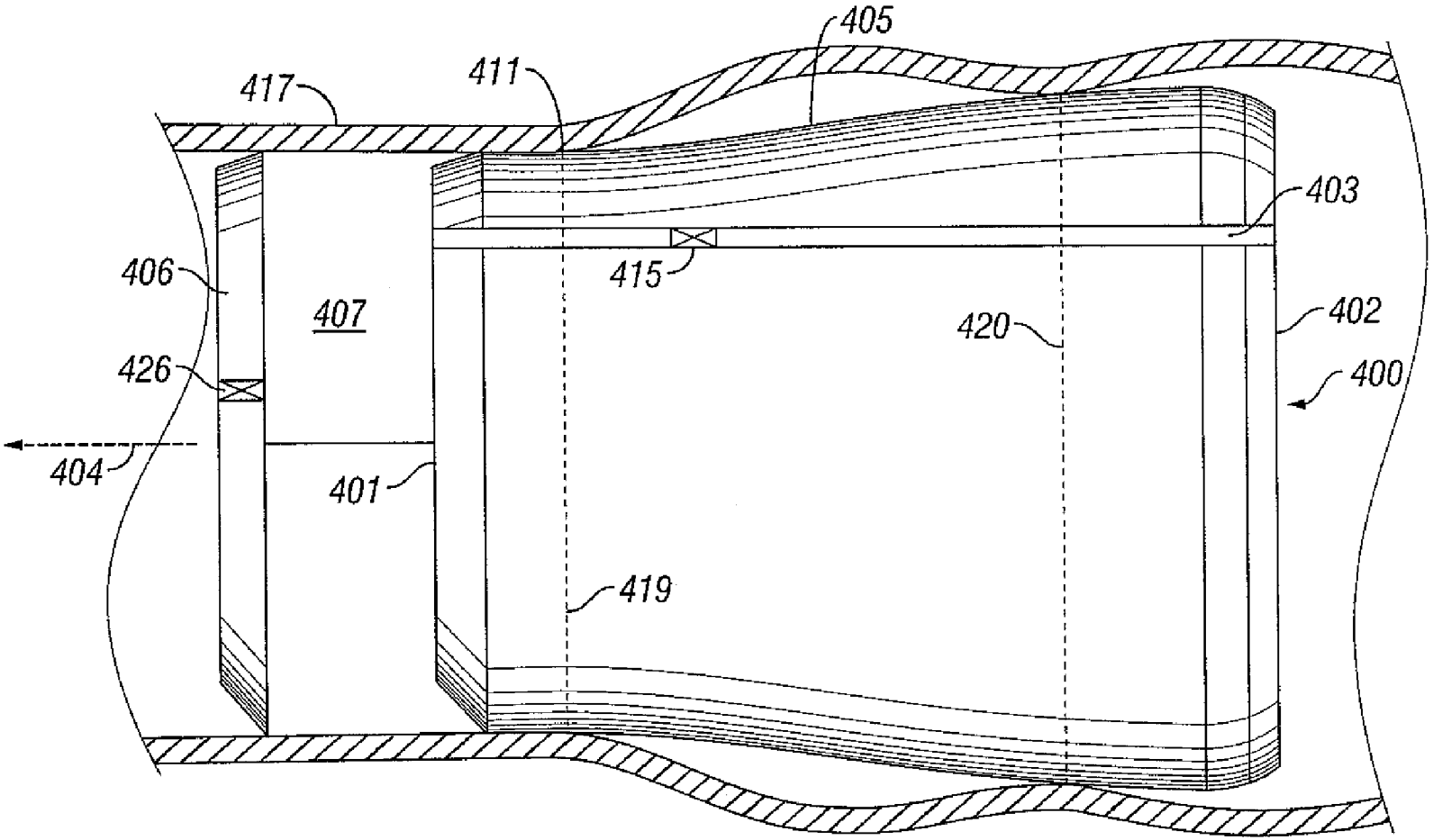
FIG. 4A shows a cross-sectional view of another embodiment of the expansion tool of the current invention.

FIG. 4A shows a cross-section of an embodiment of the expansion tool 400 of the current invention entering a casing or pipe 417 to be expanded. Expansion tool 400 has a proximal end 401, a distal end 402, and an outer surface 405. A forward contact ring 419 forms at a contact point 411 on the surface 405 of the expansion tool 400. In this embodiment a sealing body 406 is attached to the proximal end 401 of the expansion tool 400. The expansion tool 400 and the attached sealing body 406 are moved through the casing 417 in a direction of travel 404. A hydraulic channel 403, bored through the expansion tool 400, extends from the distal end 402 to the proximal end 401 of the expansion tool 400. The hydraulic channel 403 transmits the hydraulic pressure from behind the expansion tool 400 to an interstitial volume 407 ahead of the expansion tool 400 and behind the sealing body 406. The resulting pressure contained in interstitial volume 407 is higher than the pressure in front of the sealing body 406 and preferably lower than the pressure behind the expansion tool 400. At least one pressure regulation valve 415 can be used to regulate the pressure in the hydraulic channel and in volume 407. One skilled in the art will appreciate that different pressures may be used in volume 407, depending on the design of the expansion tool, coefficient of friction, the casing material properties and dimensions, and the speed of the expansion tool 400. For lubrication, fluids can also be pumped downhole in a slug, or pill, through the drillpipe and out the channels 403, 408 in the expansion tool. The expansion tool 400 is adapted to control the fluid flow from behind the distal end 402 to a location in front of the proximal end 401. At least one pressure regulation valve 426 is disposed in the sealing body 406, to control the fluid flow from behind the distal end 402 of the expansion tool 400 to a location in front of the sealing body 406. This allows slugs or hydraulic fluid to be transmitted to a location in front of the sealing body 406 of the tool 400 to increase lubricity. Those of ordinary skill in the art will appreciate that other methods may be used to control the rate of fluid flow. For example, small axial grooves in the sealing body 406, or a helical groove around the circumference of the sealing body 406, may be used to transmit the slugs or hydraulic fluid to a location in front of the proximal end 401.

The hydraulic pressure in volume 407 pre-stresses the casing 417 prior to expansion caused by the expansion tool 400. Hydraulic horsepower transmitted to the space between the casing 417 and the expansion tool 400 created by the wave-like movement of the casing 417, reduces the axial force required to expand the casing 417. The hydraulic pressure in volume 407 attenuates the wave-like behavior of the casing 417 by dampening the rebound of the steel, thus moving subsequent contact ring 420 to a location axially behind the location of a subsequent contact ring (e.g., 220 in FIG. 2). That is, the distance between consecutive contact rings 419, 420 is lengthened.

Figure 4B:
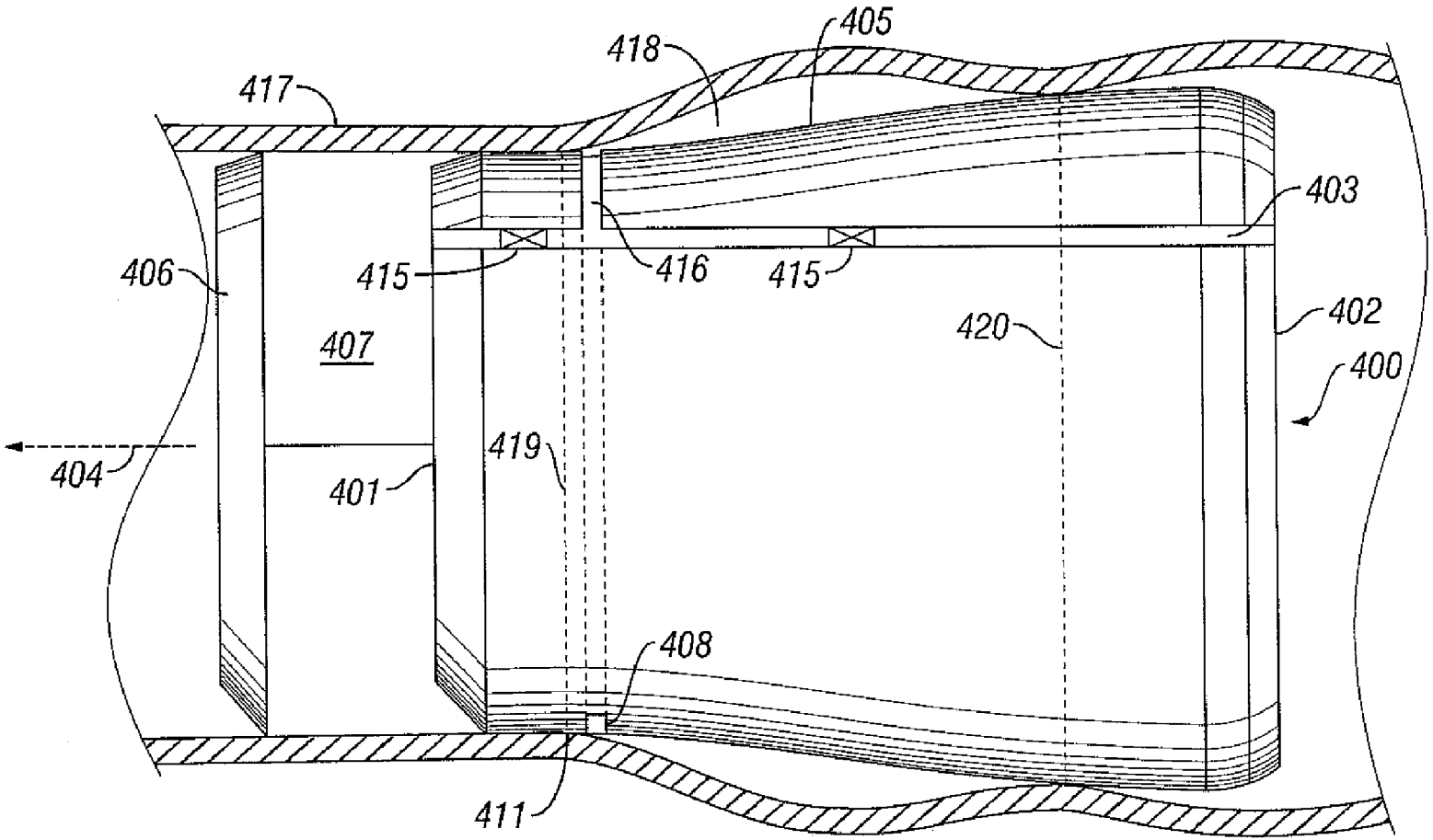
FIG. 4B shows a cross-sectional view of another embodiment of the expansion tool of the current invention.

FIG. 4B shows a cross-section of an embodiment of the expansion tool 400 of the current invention entering a casing or pipe 417 to be expanded. Expansion tool 400 has a proximal end 401, a distal end 402, and an outer surface 405. A forward contact ring 419 forms at a contact point 411 on the surface 405 of the expansion tool 400. A sealing body 406 is attached to the proximal end 401 of the expansion tool 400. The expansion tool 400 and the attached sealing body 406 are moved through the casing 417 in a direction of travel 404.

A hydraulic channel 403, bored through the expansion tool 400, extends axially from the distal end 402 to the proximal end 401 of the expansion tool 400. In this embodiment, a vent channel 416 connects the axial hydraulic channel 403 to outside of expansion tool 400 or to a circumferential channel 408 optionally disposed on the outer surface 405 of the expansion tool 400 behind a contact ring 419. The hydraulic channel 403 transmits hydraulic pressure from behind the expansion tool 400 to an interstitial volume 407 ahead of the expansion tool 400 and behind the sealing body 406. The vent channel 416 transmits pressure from the axial hydraulic channel 403 to the volume 418 or to the circumferential channel 408. The resulting pressure contained in the interstitial volume 407 is higher than the pressure in front of the sealing body 406 and preferably lower than the pressure behind the expansion tool 400.

The resulting pressure contained in circumferential channel 408, and consequently in the volume 418, is higher than the pressure in front of the sealing body 406, and preferably higher than the pressure in the interstitial volume 407, but lower than the pressure behind the expansion tool 400. However, one skilled in the art will appreciate that different pressures may be used depending on the design of the expansion tool, coefficient of friction, the casing material properties and dimensions, and the speed of the expansion tool. For lubrication, fluids can also be pumped downhole in a slug, or pill, through the drillpipe and out the channels 403, 416, 408 in the expansion tool. The expansion tool 400 is also adapted to control the fluid flow from behind the distal end 402 to a location in front of the proximal end 401. At least one pressure regulation valve may be disposed in the sealing body 406 to control the fluid flow from behind the distal end 402 of the expansion tool 400 to a location in front of the sealing body 406. This allows slugs or hydraulic fluid to be transmitted to a location in front of the sealing body 406 of the tool 400 to increase lubricity. Those of ordinary skill in the art will appreciate that other methods may be used to control the rate of fluid flow. For example, small axial grooves in the sealing body 406, or a helical groove around the circumference of the sealing body 406, may be used to transmit the slugs or hydraulic fluid to a location in front of the proximal end 401.

At least one pressure regulation valve 415 can be used to regulate the pressure in the interstitial volume 407 and at least one pressure regulation valve 415 can be used to regulate the pressure in the circumferential channel 408 and in volume 418. The hydraulic pressure in the interstitial volume 407 pre-stresses the casing 417 prior to expansion caused by the expansion tool 400. The pressure contained in the circumferential channel 408 and the volume 418, serves to attenuate the wave-like movement of the casing 417 by dampening the rebound of the steel. The expansion tool 400 may comprise a plurality of circumferential channels 408 each disposed behind a contact ring (e.g., 419 or 420). Hydraulic horsepower transmitted to the space between the casing 417 and the expansion tool 400 created by the wave-like movement of the casing 417, reduces the axial force required to expand the casing 417. The hydraulic pressure in the interstitial volume 407 and volume 418 attenuates the wave-like behavior of the casing 417, thus moving subsequent contact ring 420 to a location axially behind the location of a subsequent contact ring (e.g., 220 in FIG. 2) created by a conventional expansion tool. That is, the distance between consecutive contact rings 419, 420 is lengthened.

Figure 4C:
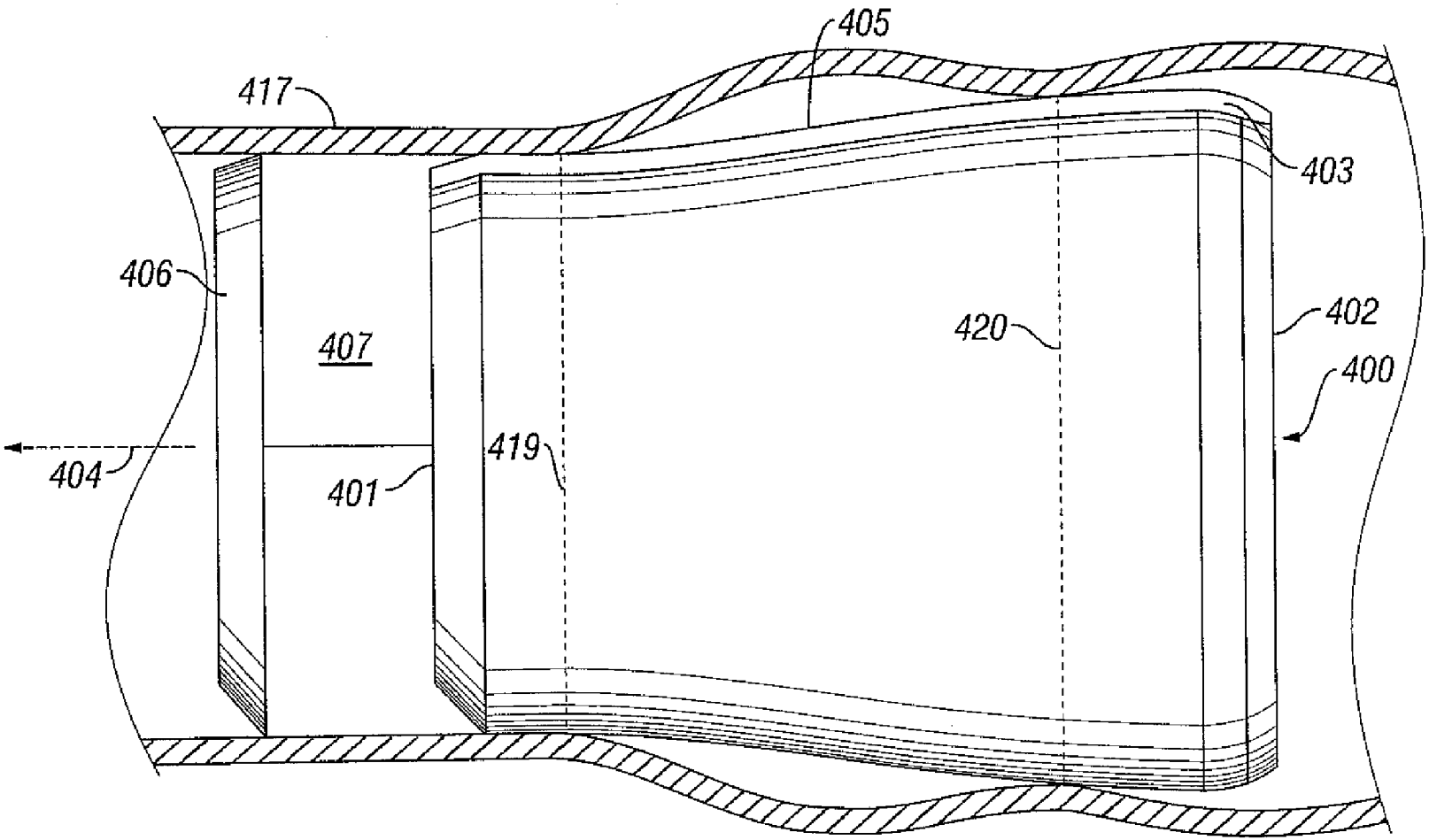
FIG. 4C shows a cross-sectional view of another embodiment of the expansion tool of the current invention.

FIG. 4C shows a cross section of an embodiment of the expansion tool 400 of the current invention entering a casing or pipe 417 to be expanded. The expansion tool 400 is similar to that presented in FIG. 4A; however, at least one hydraulic channel 403 is disposed on the surface 405 of the expansion tool 400. One skilled in the art will appreciate that different axial lengths and the circumferential widths of the hydraulic channel 403 may be used depending on the design of the expansion tool, coefficient of friction, the casing material properties and dimensions, and the speed of travel of the expansion tool 400. The hydraulic channel 403 transmits the hydraulic pressure from behind the expansion tool 400 along the outside diameter of the tool to a point forward from the distal end 402 of the tool 400. The expansion tool 400 may also comprise a circumferential channel 408 (FIG. 4B), disposed on the outer surface 405 of the expansion tool 400 behind the forward contact ring 419. The hydraulic channel 403 transfers the hydraulic pressure from behind the tool 400 to the circumferential channel 408. The expansion tool 400 may comprise a plurality of circumferential channels 408, each disposed behind a contact ring (e.g. 419 or 420). Hydraulic horsepower transmitted to the space between the casing 417 and the expansion tool 400 created by the wave-like movement of the casing 417, reduces the axial force required to expand the casing 417. The hydraulic pressure lubricates the area between the inside surface of the casing 417 and the tool 400 inside the casing, making it easier to move the expansion tool 400 through the casing 417.

For added lubrication, fluids can also be pumped downhole in a slug, or pill, through the drillpipe and out the channels 403, 408 in the expansion tool. The expansion tool 400 is also adapted to control the fluid flow from behind the distal end 402 to a location in front of the proximal end 401. At least one pressure regulation valve may be disposed in the sealing body 406 to control the fluid flow from behind the distal end 402 of the expansion tool 400 to a location in front of the sealing body 406. This allows slugs or hydraulic fluid to be transmitted to a location in front of the sealing body 406 of the tool 400 to increase lubricity. Those of ordinary skill in the art will appreciate that other methods may be used to control the rate of fluid flow. For example, small axial grooves in the sealing body 406, or a helical groove around the circumference of the sealing body 406, may be used to transmit the slugs or hydraulic fluid to a location in front of the proximal end 401.

Figure 5A:
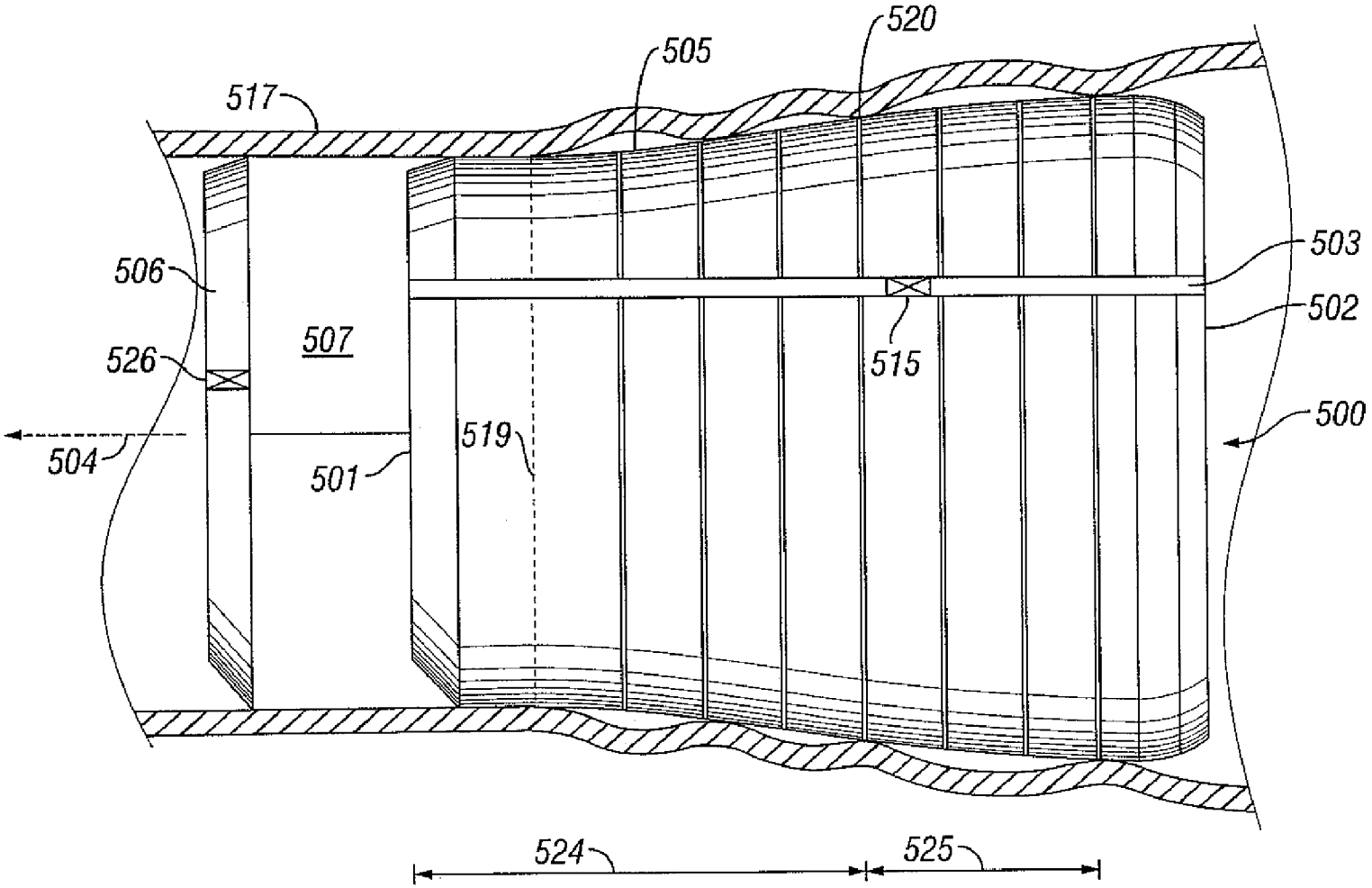
FIG. 5A shows a cross-sectional view of another embodiment of the expansion tool of the current invention.

FIG. 5A shows a cross-section of an embodiment of the expansion tool 500 of the current invention entering a casing or pipe 517 to be expanded. Expansion tool 500 has a proximal end 501, a distal end 502, and an outer surface 505. A sealing body 506 is attached to the proximal end 501 of the expansion tool 500.

In this embodiment, the expansion tool 500 has a first section 524, wherein the diameter increases at a rate that increases towards the distal end 502 of the expansion tool 500, and a second section 525, wherein the diameter increases at a rate that decreases towards the distal end 502 of the expansion tool 500, as disclosed in U.S. Pat. No. 6,622,797 assigned to the assignee of the current invention. That is, section 524 has a concave surface, while section 525 has a convex surface. The expansion tool 500 and the attached sealing body 506 are moved through the casing 517 in a direction of travel 504.

A hydraulic channel 503, bored through the expansion tool 500, extends from the distal end 502 to the proximal end 501 of the expansion tool 500. The hydraulic channel 503 allows for the hydraulic pressure from behind the expansion tool 500 to move to an interstitial volume 507 ahead of the expansion tool 500 and behind the sealing body 506. The resulting pressure contained in interstitial volume 507 is higher than the pressure in front of the sealing body 506 and preferably lower than the pressure behind the expansion tool 500. However, one skilled in the art will appreciate that different pressures in the interstitial volume 507 may be used, depending on the design of the expansion tool, coefficient of friction, the casing material properties and dimensions, and the speed of travel of the expansion tool 500.

At least one pressure regulation valve 515 can be used to regulate the pressure in the hydraulic channel 503 and in interstitial volume 507. The hydraulic pressure in interstitial volume 507 pre-stresses the casing 517 prior to expansion caused by the expansion tool 500. Hydraulic horsepower transmitted to the space between the casing 517 and the expansion tool 500 created by the wave-like movement of the casing 517, reduces the axial force required to expand the casing 517. The hydraulic pressure in interstitial volume 507 attenuates the wave-like behavior of the casing 517 by dampening the rebound of the steel, thus reducing the amplitude of the "bounce" of the casing 517.

For lubrication, fluids can also be pumped downhole in a slug, or pill, through the drillpipe and out the channels 503 in the expansion tool. The expansion tool 500 is adapted to control the fluid flow from behind the distal end 502 to a location in front of the proximal end 501. At least one pressure regulation valve 526 is disposed in the sealing body 506 to control the fluid flow from behind the distal end 502 of the expansion tool 400 to a location in front of the sealing body 506. This allows slugs or hydraulic fluid to be transmitted to a location in front of the sealing body 506 of the tool 500 to increase lubricity. Those of ordinary skill in the art will appreciate that other methods may be used to control the rate of fluid flow. For example, small axial grooves in the sealing body 506, or a helical groove around the circumference of the sealing body 506, may be used to transmit the slugs or hydraulic fluid to a location in front of the proximal end 501.

Figure 5B:
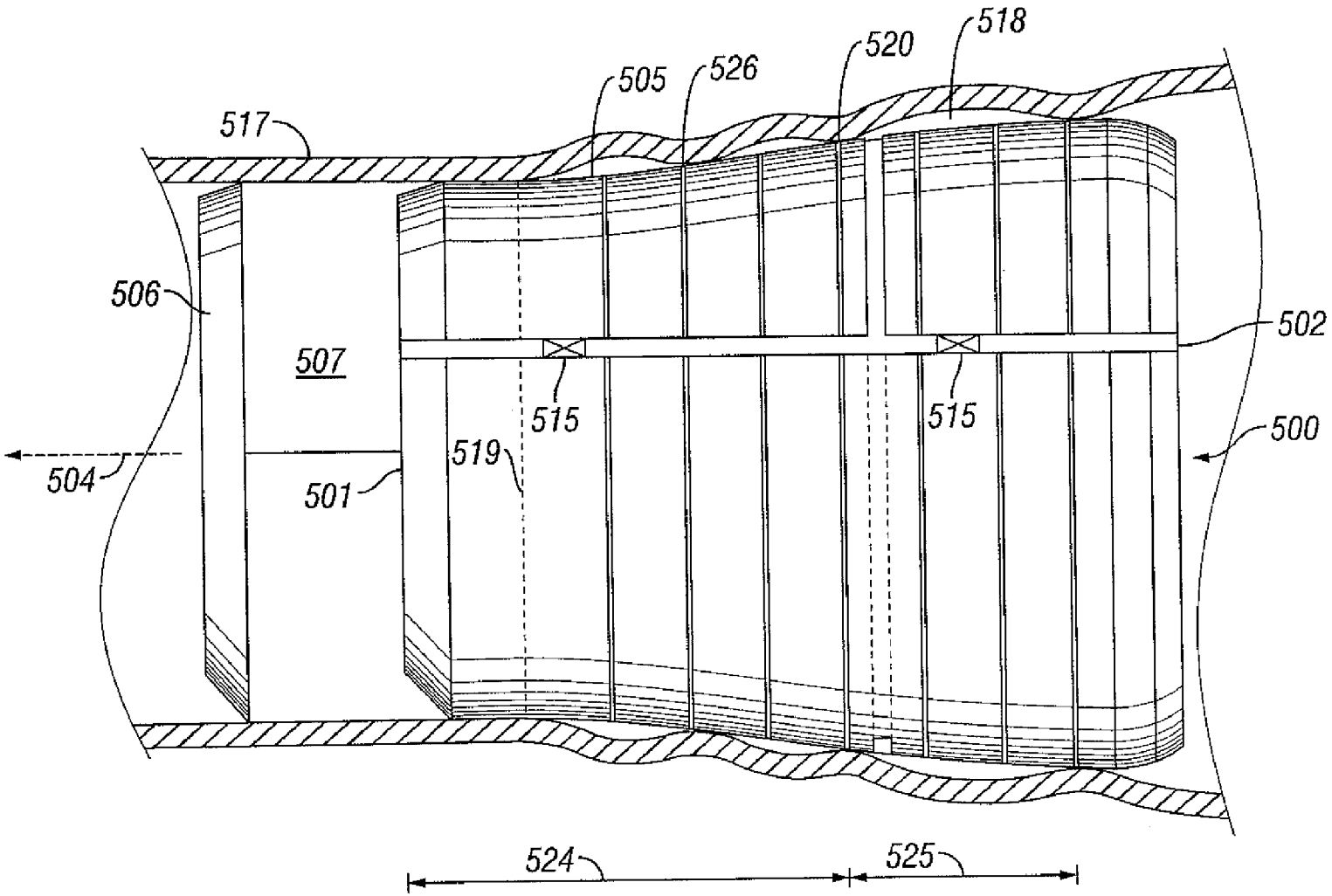
FIG. 5B shows a cross-sectional view of another embodiment of the expansion tool of the current invention.

FIG. 5B shows a cross-section of an embodiment of the expansion tool 500 of the current invention entering a casing or pipe 517 to be expanded. Expansion tool 500 has a proximal end 501, a distal end 502, and an outer surface 505. A sealing body 506 is attached to the proximal end 501 of the expansion tool 500. The expansion tool 500 has a first section 524, wherein the diameter increases at a rate that increases toward the distal end 502 of the expansion tool 500, and a second section 525, wherein the diameter increases at a rate that decreases toward the distal end 502 of the expansion tool, as disclosed in U.S. Pat. No. 6,622,797 assigned to the assignee of the current invention. The first section 524 forms a generally concave surface and the second section 525 forms a generally convex surface. The resulting inflection point creates a contact ring 520 between the expansion tool 500 and the casing 517.

The expansion tool 500 and the attached sealing body 506 are moved through the casing 517 in a direction of travel 504. A hydraulic channel 503, bored through the expansion tool 500, extends axially from the distal end 502 to the proximal end 501 of the expansion tool 500. A vent channel 516 connects the axial hydraulic channel 503 to the side of the expansion tool 500 or to a circumferential channel 508 optionally disposed on the outer surface of the expansion tool 500 behind a contact ring 520.

While a contact ring 526, may occur before the contact ring 520, along the direction of travel 504, a contact ring 520 is formed at the inflection point of the outside diameter of the expansion tool 500. The hydraulic channel 503 allows hydraulic pressure from behind the expansion tool 500 to be transmitted to an interstitial volume 507 ahead of the expansion tool 500 and behind the sealing body 506. The vent channel 516 transmits pressure from the axial hydraulic channel 503 to the side of the expansion tool or to the circumferential channel 508. The resulting pressure contained in the interstitial volume 507 is higher than the pressure in front of the sealing body 506 and preferably lower than the pressure behind the expansion tool 500.

The resulting pressure contained in circumferential channel 508, and consequently in the volume 518, is higher than the pressure in front of the sealing body 506, and preferably higher than the pressure in the interstitial volume 507, but lower than the pressure behind the expansion tool 500. However, one skilled in the art will appreciate that different pressures in the circumferential channel 508 or the volume 518 may be used, depending on the design of the expansion tool, coefficient of friction, the casing material properties and dimensions, and the speed of travel of the expansion tool 500.

At least one pressure regulation valve 515 can be used to regulate the pressure in the interstitial volume 507 and at least one to regulate the pressure in the circumferential channel 508 and in volume 518. The hydraulic pressure in the interstitial volume 507 pre-stresses the casing 517 prior to expansion caused by the expansion tool 500. The pressure contained in the circumferential channel 508 and the volume 518, serves to further pres-stress the casing 517. The expansion tool 500 may comprise a plurality of circumferential channels 508, each disposed behind a contact ring (e.g. 519 or 520). The hydraulic pressure in the interstitial volume 507 and volume 518 attenuates the wave-like behavior of the casing 517 by dampening the rebound of the steel. Thus, the amplitude of the "bounce" of the casing 517 is reduced. Hydraulic horsepower transmitted to the space between the casing 517 and the expansion tool 500 created by the wave-like movement of the casing 517, reduces the axial force required to expand the casing 517.

For lubrication, fluids can also be pumped downhole in a slug, or pill, through the drillpipe and out the channels 503, 516, and 508 in the expansion tool. The expansion tool 500 is adapted to control the fluid flow from behind the distal end 502 to a location in front of the proximal end 501. At least one pressure regulation valve may be disposed in the sealing body 506 to control the fluid flow from behind the distal end 502 of the expansion tool 400 to a location in front of the sealing body 506. This allows slugs or hydraulic fluid to be transmitted to a location in front of the sealing body 506 of the tool 500 to increase lubricity. Those of ordinary skill in the art will appreciate that other methods may be used to control the rate of fluid flow. For example, small axial grooves in the sealing body 506, or a helical groove around the circumference of the sealing body 506, may be used to transmit the slugs or hydraulic fluid to a location in front of the proximal end 501.

Advantages of the invention may include one or more of the following: An expansion tool of the invention has the ability to radially plastically deform casing, thereby reducing the annular space between the drilled wellbore and casing string. An expansion tool of the invention has the ability to pre-stress the casing while moving through the casing. An expansion tool of the invention has the ability to reduce the axial force required to expand the casing. An expansion tool of the invention has the ability to attenuate the wave-like behavior of the casing generated when the expansion tool is moved through the casing. An expansion tool of the invention has the ability to control fluid flow from behind the tool to a location in front of the tool, and provide lubrication to the proximal end of the tool.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. An expansion tool, comprising:

a tool body comprising a proximal end, a distal end, an outer surface, wherein the tool body is configured to be engaged into and displaced through a tubular to be expanded along a direction of travel;

at least one hydraulic channel extending through the tool body from the distal end;

a sealing body adapted to isolate a fluid volume behind the sealing body from a fluid volume in front of the sealing body; and a plurality of contact rings formed on the outer surface that contact the tubular to be expanded, wherein the expansion tool is configured to control a fluid flow from behind the distal end to in front of the proximal end.

2. The expansion tool of claim 1, wherein the sealing body is axially disposed ahead of the tool body along the direction of travel.

3. The expansion tool of claim 1, wherein the sealing body is integral with the proximal end of the tool body.

4. The expansion tool of claim 1, wherein the at least one hydraulic channel extends from the distal end to at least one point upon the outer surface of the tool body located between two contact rings.

5. The expansion tool of claim 1, wherein the at least one hydraulic channel extends from the distal end to the proximal end of the tool body.

6. The expansion tool of claim 1, wherein the at least one hydraulic channel extends from the distal end to the fluid volume behind the sealing body.

7. The expansion tool of claim 1, wherein the hydraulic channel comprises a check valve.

8. The expansion tool of claim 1, wherein the sealing body comprises a check valve.

9. The expansion tool of claim 1, wherein the hydraulic channel comprises a pressure regulation valve.

10. The expansion tool of claim 1, wherein the expansion tool controls the fluid flow using a pressure regulation valve.

11. The expansion tool of claim 1, wherein the expansion tool controls the fluid flow using small axial grooves.

12. The expansion tool of claim 1, wherein the expansion tool controls the fluid flow using a helical groove.

* * * * *